US008870596B2

(12) United States Patent
Ii

(10) Patent No.: US 8,870,596 B2
(45) Date of Patent: Oct. 28, 2014

(54) SHIELDED CONNECTOR

(75) Inventor: Ryosuke Ii, Susono (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/592,838

(22) Filed: Aug. 23, 2012

(65) Prior Publication Data

US 2013/0052866 A1 Feb. 28, 2013

(30) Foreign Application Priority Data

Aug. 25, 2011 (JP) ..... 2011-184055

(51) Int. Cl.
*H01R 9/03* (2006.01)
*H01R 13/6581* (2011.01)
*H01R 13/6593* (2011.01)

(52) U.S. Cl.
CPC ..... *H01R 13/6581* (2013.01); *H01R 9/038* (2013.01); *H01R 13/6593* (2013.01)
USPC ..... 439/607.41; 439/607.48

(58) Field of Classification Search
USPC ..... 439/607.5, 607.41, 607.47, 607.48, 439/607.56, 607.55, 607.27
See application file for complete search history.

(56) References Cited

U.S. PATENT DOCUMENTS 4,337,989 A * 7/1982 Asick et al. ..... 439/607.23
5,397,246 A * 3/1995 Defibaugh et al. ..... 439/352
5,518,421 A * 5/1996 Davis ..... 439/607.5
5,683,269 A * 11/1997 Davis et al. ..... 439/607.5
5,725,395 A * 3/1998 Lee ..... 439/607.48
5,911,599 A 6/1999 Masuda
6,039,606 A * 3/2000 Chiou ..... 439/607.45
6,200,162 B1 * 3/2001 Aoyama et al. ..... 439/578
6,206,727 B1 3/2001 Aoyama et al.
6,210,223 B1 4/2001 Aoyama et al.
6,565,388 B1 * 5/2003 Van Woensel et al. .. 439/607.48
6,599,151 B2 * 7/2003 Chiran et al. ..... 439/607.48
6,659,801 B2 * 12/2003 Nishio et al. ..... 439/607.48

(Continued)

FOREIGN PATENT DOCUMENTS

CN 1254969 A 5/2000
CN 102891388 A 1/2013
JP 8-330026 A 12/1996
JP 2001-332356 A 11/2001

OTHER PUBLICATIONS

Communication dated Jun. 3, 2014, issued by the State Intellectual Property Office of the People's Republic of China in counterpart Chinese Application No. 201210308806.8.

*Primary Examiner* — Briggitte R Hammond
(74) *Attorney, Agent, or Firm* — Sughrue Mion, PLLC

(57) ABSTRACT

Herein disclosed is a shielded connector that makes it possible to bring a shielded shell into reliable contact with a shielded shell cover while pursing further miniaturization. A shielded connector 11 includes a shielded shell 19 having a barrel 55 for fixing a sheath 33 of a shielded electric wire 27 and a rectangular cylindrical shield 47 having an opening 51 in an upper surface 49 of the shell; and a shielded shell cover 21 that has a pair of mutually opposed insertion laps 57 to cover the opening 51 and that assumes a substantially C-shaped cross sectional profile. When the pair of insertion laps 57 are inserted inside the shielded shell 19 in order to cover the opening 51, protuberances 61 provided on the pair of insertion laps 57 press side plate interior surfaces of the shielded shell 19.

2 Claims, 5 Drawing Sheets

(56) References Cited

U.S. PATENT DOCUMENTS

| | | | | |
|---|---|---|---|---|
| 6,783,397 | B2 * | 8/2004 | Yang Lee | 439/607.45 |
| 6,913,489 | B2 * | 7/2005 | Chai et al. | 439/607.54 |
| 7,033,218 | B2 * | 4/2006 | Huang et al. | 439/607.04 |
| 7,367,841 | B1 * | 5/2008 | Lin | 439/607.01 |
| 7,465,194 | B1 * | 12/2008 | Ho et al. | 439/607.01 |
| 7,479,037 | B2 * | 1/2009 | Bernat et al. | 439/607.41 |
| 7,632,155 | B1 * | 12/2009 | Wu | 439/660 |
| 7,896,559 | B2 * | 3/2011 | Yi et al. | 439/660 |
| 2001/0046809 | A1 | 11/2001 | Chiran et al. | |
| 2013/0023155 | A1 | 1/2013 | Ii | |

* cited by examiner

SHIELDED CONNECTOR

BACKGROUND

The present invention relates to a shielded connector.

A hitherto known shielded connector exhibits a shielding function by means of covering an inner housing made from an insulating resin with a metal shield shell (see; for instance, Patent Documents 1 and 2).

For instance, a shielded connector described in connection with Patent Document 2, or the like, has a plurality of terminals connected to respective signal lines exposed at an end of a shielded cable; an insulator body (an inner housing) accommodating and retaining the respective terminals; a shielding metal cover (a shielded shell and shielded shell cover) for covering an exterior of the insulator body, wire connections of electric wires of the respective terminals, and entire portions of the respective signal lines exposed outside the shield; and an insulating cover housing (an outer housing) fitted to an exterior of the shielding metal cover.

The shielding metal cover has; for instance, a pair of C-shaped, mutually opposed cover bodies that engage with each other. A ferrule (a wire fixing section) for swaging and nipping a shield layer of the shielded cable is continually provided at a rear end of one C-shaped cover body (a shielded shell). The insulator body accommodating and holding the terminals connected to the respective signal lines is fitted to the one C-shaped cover body, and the shield layer of the shielded cable is nipped by means of the ferrule. Subsequently, the shielded connector is assembled in such a way that both sides of a remaining C-shaped cover body (a shielded shell cover) overlap their counterpart side plates of the one C-shaped cover body from the outside, thereby making up a rectangular, cylindrical shielding body.

Specifically, after the shield layer of the shielded cable has been swaged and nipped by means of the ferrule of the one C-shaped cover body, portions of the signal lines exposed outside the shield in the vicinity of the ferrule are covered with the other C-shaped cover body, whereby the shielding metal cover can cover the wire connections of the terminals housed and retained in the insulator body and the entire portions of the signal lines exposed outside the shield. Accordingly, a shielded connector exhibiting superior shielding performance can be obtained.

Incidentally, the shielded connector described in connection with Patent Document 2, and the like, forms the rectangular, cylindrical shielding body. Hence, the shielded connector is assembled in such a way that both side plates of the remaining C-shaped cover body overlap their counterpart side plates of the one C-shaped cover body from the outside. On this occasion, both side plates must be brought into reliable contact with each other in order to let the shielded connector exhibit superior shielding performance.

Moreover, in order to miniaturize the shielded connector, there is an ever-increasing demand for reducing the size of the shielding metal cover.

However, the C-shaped cover bodies making up the shielding metal cover are manufactured by pressing a thin metal plate. When an attempt is made to further miniaturize the shielding metal cover, dimensional tolerance and spring back which will occur during pressing or an error which will arise during assembly operation poses difficulties in bringing both side plates of the C-shaped cover bodies into reliable contact with each other.

[Patent Document 1] Japanese Patent Publication No. JP-A-8-330026

[Patent Document 2] Japanese Patent Publication No. JP-A-2001-332356

SUMMARY

The present invention has been conceived in light of the circumstance and aims at providing a shielded connector that makes it possible to bring a shielded shell into reliable contact with a shielded shell cover while pursing further miniaturization.

The objective of the present invention is accomplished by the following configurations.

(1) A shielded connector including:

a shielded shell having an electric wire fixing section for fixing a sheath of a shielded electric wire and a rectangular cylindrical shield having an opening in an upper surface of the shell; and a shielded shell cover that has a pair of mutually opposed insertion laps to cover the opening and that assumes a substantially C-shaped cross sectional profile, wherein when the pair of insertion laps are inserted inside the shielded shell in order to cover the opening, protuberances provided on the pair of insertion laps press side plate interior surfaces of the shielded shell.

In the shielded connector having the configuration described in connection with (1), the pair of insertion laps of the shielded shell cover formed so as to assume a substantially C-shaped cross sectional profile are formed such that leading ends of the respective insertion laps become rather broadened by means of; for instance, spring back, in the folding process. The protuberances projecting to the outside with respect to the broadening direction are formed on the respective insertion laps. When the shielded shell cover is attached to the shielded shell, the insertion laps on both sides of the shielded shell are inserted so as to cover overlap the respective side plate interior surfaces of the shielded shell. On this occasion, since the leading ends of the pair of insertion laps remain broadened, the insertion laps are inserted into insertion clearance while being nipped in a closing direction. The insertion laps inserted into the inside of the shielded shell are again broadened by means of elastic restoring force, thereby pressing the side plate interior surfaces of the respective shielded shell. Accordingly, since the protuberances on the respective insertion laps reliably press the side plate interior surfaces of the shielded shell, it is possible to prevent deformation of the side plates or creation of instability in a state of a contact, which would otherwise be caused by an assembly error, or the like.

(2) The shielded connector according to the above described (1), wherein the protuberances are longitudinal groove-like protuberances projectingly provided along a direction of insertion of the shielded connector.

By means of the shielded connector having the configuration described in connection with (2), a contact area between the shielded shell and the shielded shell cover can be increased. Further, rigidity of the insertion laps of the shielded shell cover can be enhanced.

(3) The shielded connector according to the above described (1) or (2), wherein contacts that oppose the respective protuberances are provided in a projecting manner on the respective side plate interior surfaces of the shielded shell.

By means of the shielded connector having the configuration described in connection with (3), the shielded shell and the shielded shell cover can come into contact with each other in a more reliable manner by means of the protuberances and the contacts that mutually project in a contacting direction.

The shielded connector of the present invention makes it possible to bring a shielded shell into reliable contact with a shielded shell cover while pursuing further miniaturization. Accordingly, a compact shielded connector exhibiting superior shielding performance can be provided.

The present invention has been briefly described thus far. Details of the present invention will be more clarified, so long as embodiments for implementing the present invention to be described below (hereinafter referred to simply as "embodiments") are read through by reference to the accompanying drawings.

DETAILED DESCRIPTION OF EXEMPLIFIED EMBODIMENTS

A shielded connector of an embodiment of the present invention is hereunder described in detail by reference to the accompanying drawings.

A shielded connector 11 of the embodiment can be preferably used as a shielded connector for a USB 2.0 (a differential connector for high speed transmission purpose) cable.

Figure 1:
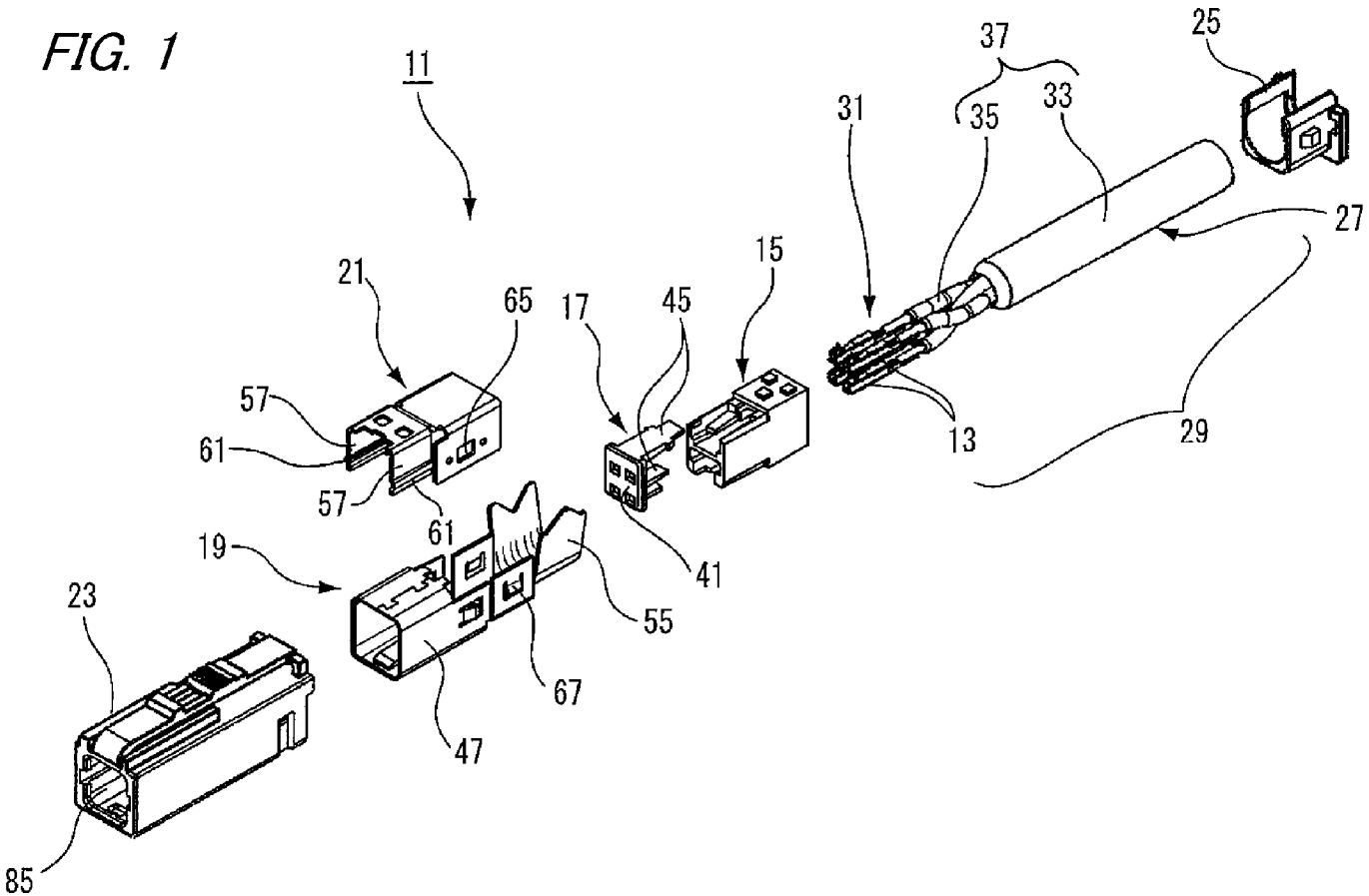
FIG. 1 is an exploded perspective view of a shielded connector of an embodiment of the present invention.

As shown in FIG. 1, the shielded connector 11 has terminals 13, an inner housing 15, a front folder 17, a shielded shell 19, a shielded shell cover 21, an outer housing 23, and a rear folder 25.

The terminals 13 are formed by means of sheet metal working. In the present embodiment, each of the terminals 13 is embodied as a female terminal having a box-shaped electric contact 14 shown in FIG. 4. A contact piece 18 is formed in each of the electric contacts 14, and each of the contact pieces 18 contacts a plate-like tab 98 of a counterpart male terminal shown in FIG. 6B. A terminal bend 20 with which a housing lance 16 to be described later is engaged is formed in an upper portion of each of the electric contacts 14. The terminals 13 are connected to a shielded wire 27, thereby forming a terminal-equipped shielded electric wire 29.

In a juncture 31 where the shielded electric wire 27 is coupled to the terminals 13, a sheath 33 and a coat 37 of a shield foil 35 must be peeled off from the shielded electric wire 27. The portion of the shielded electric wire 27 from which the coat 37 has been peeled induces impedance mismatch, which in turn deteriorates transmission performance. For this reason, a shorter length of an area from which the coat 37 is peeled is better.

The inner housing 15 is molded from a synthetic resin material. The inner housing 15 has a plurality of terminal accommodation chambers 39 (see FIG. 4 and FIG. 5A) into which the terminals 13 crimped to the plurality of respective shielded wire terminals of the shielded electric wire 27 are to be inserted. The respective terminals 13 are inserted into the respective terminal accommodation chambers 39 formed in the inner housing 15. The respective terminal accommodation chambers 39 are in mutual communication with respective tab insertion openings 50 opened in a front surface of the inner housing 15 shown in FIG. 4. Rear portions of the respective terminal accommodation chambers 39 are opened as terminal insertion openings 52 at a rear portion of the inner housing 15. A cantilever housing lance 16 is provided in each of the terminal accommodation chambers 39. The housing lance 16 is engaged with the terminal bend 20 of each of the terminals 13 inserted into the respective terminal accommodation chambers 39 from behind with respect to a direction of insertion of the terminal, thereby restricting dropping off of the terminals 13 and fastening the same in the terminal accommodation chambers 39.

Figure 4:
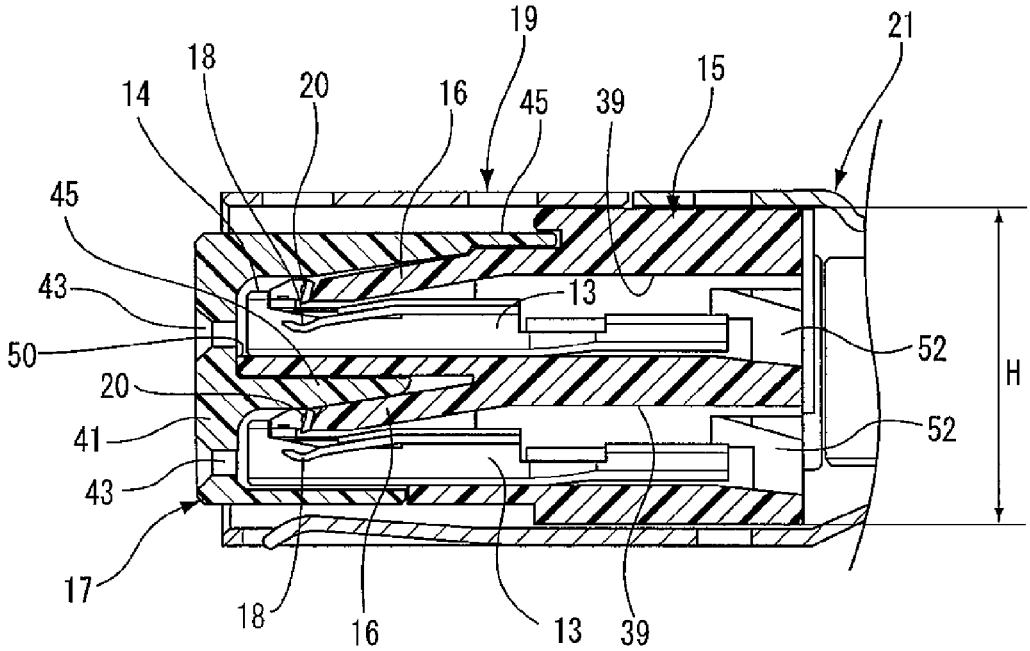
FIG. 4 is a longitudinally cross sectional view of the shielded shell accommodating an inner housing.

The front folder 17 has a front plate 41 shown in FIG. 4 and inserted into a front portion of the inner housing 15. A plurality of windows 43 matching the respective tab insertion openings 50 of the inner housing 15 are formed in the front plate 41. A plurality of lance regulation pieces 45 are projectingly formed on the front plate 41 and inserted into space of flexion of the housing lances 16. When the lance regulation pieces 45 are inserted into the space of flexion, restrictions are imposed on movements of the respective housing lances 16 in a direction of disengagement. Thus, the terminals 13 are doubly locked.

The shielded shell 19 is formed from a sheet metal plate by means of sheet metal working. The shielded shell 19 has a rectangular cylindrical shield 47 that inwardly inserts and covers the inner housing 15 and a barrel 55 serving as an electric wire fixing section that is continually provided at the rear of the shield 47, thereby fixing the sheath 33 of the shielded electric wire 27 by means of crimping.

A juncture area of the shield 47 employed in forming a rectangular cylindrical shape is embodied as a dovetail joint that is joined while one of juncture sides 53 remains formed as a dovetail, thereby making it possible to halt opening. An opening 51 intended for facilitating determination of a position where the inner housing 15 is to be inserted into the shield 47 is formed in a shell upper surface 49 of the shield 47. The opening 51 is covered with the shielded shell cover 21.

The inner housing 15 to which the terminals 13 of the terminal-equipped shielded electric wire 29 are inserted is inserted into the shielded shell 19. Further, as shown in FIG. 2, the sheath 33 of the terminal-equipped shielded electric wire 29 is fixed to the barrel 55 by means of swaging.

Figure 2:
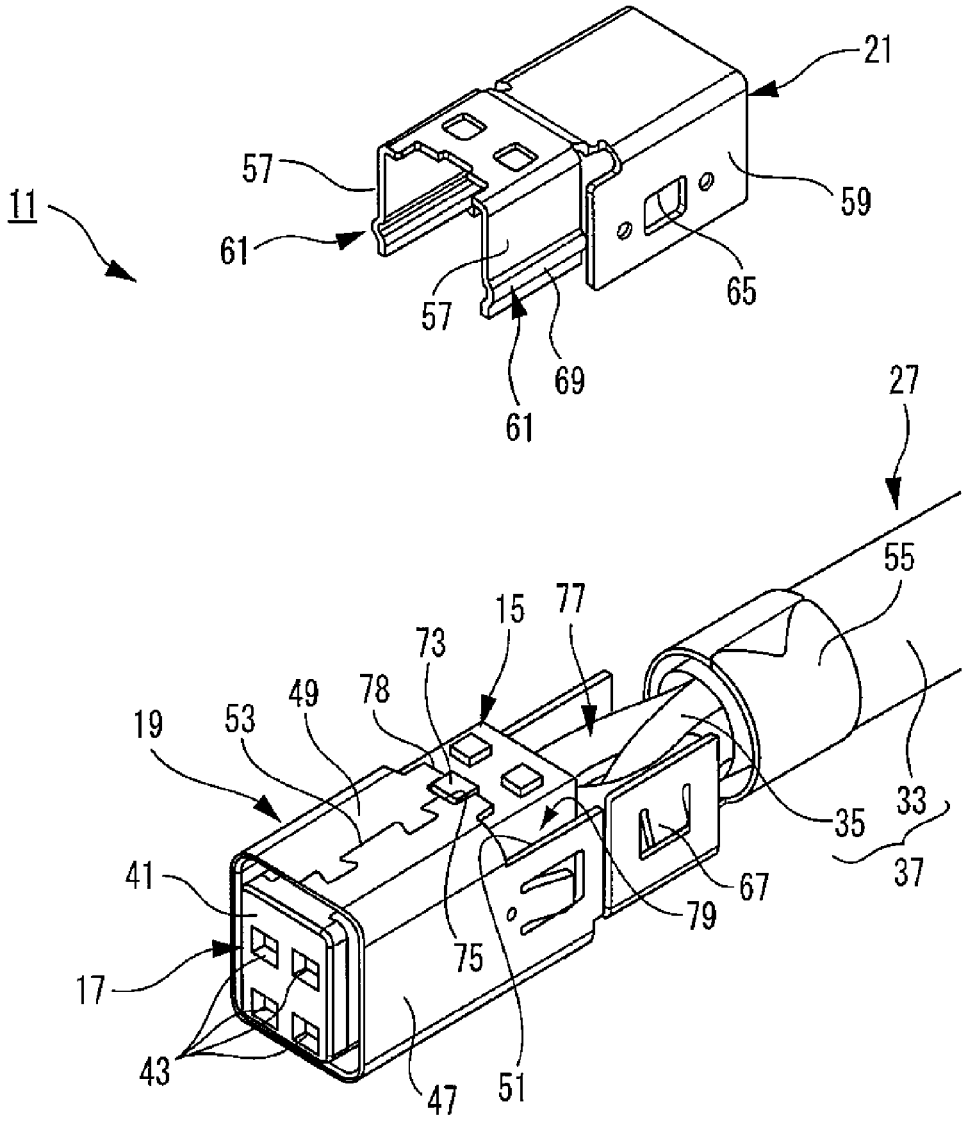
FIG. 2 is a perspective view achieved before a shielded shell is covered with a shielded shell cover.

As shown in FIG. 2, the shielded shell cover 21 is formed from a raw plate made of conductive metal and bent into a substantially C-shaped cross sectional profile by means of sheet metal working in such a way that the pair of mutually opposed parallel insertion laps 57 are formed. The pair of insertion laps 57 of the shielded shell cover 21 are formed such that leading ends (lower ends in FIG. 2) of the laps are somewhat broadened by means of; for instance, spring back, in the course of a folding process.

A pair of cover side plates 59 are formed at the rear of the insertion laps 57 of the shielded shell cover 21. The insertion laps 57 are inserted into the shielded shell 19, and the cover side plates 59 are positioned outside the shielded shell 19, whereby the shielded shell cover 21 is attached.

Figure 3:
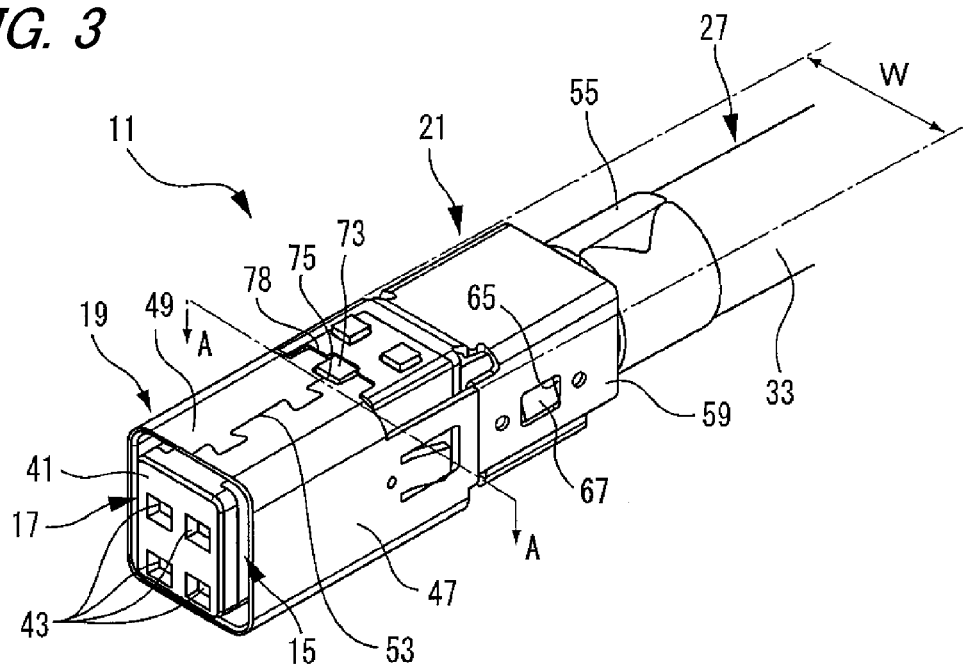
FIG. 3 is a perspective view of the shielded shell covered with the shielded shell cover.

The size of the entire connector is thereby restricted by means of the shielded shell 19 and the shielded shell cover 21 such that the shield 47 and the cover side plates 59 assume the same width W as shown in FIG. 3.

Figure 5A:
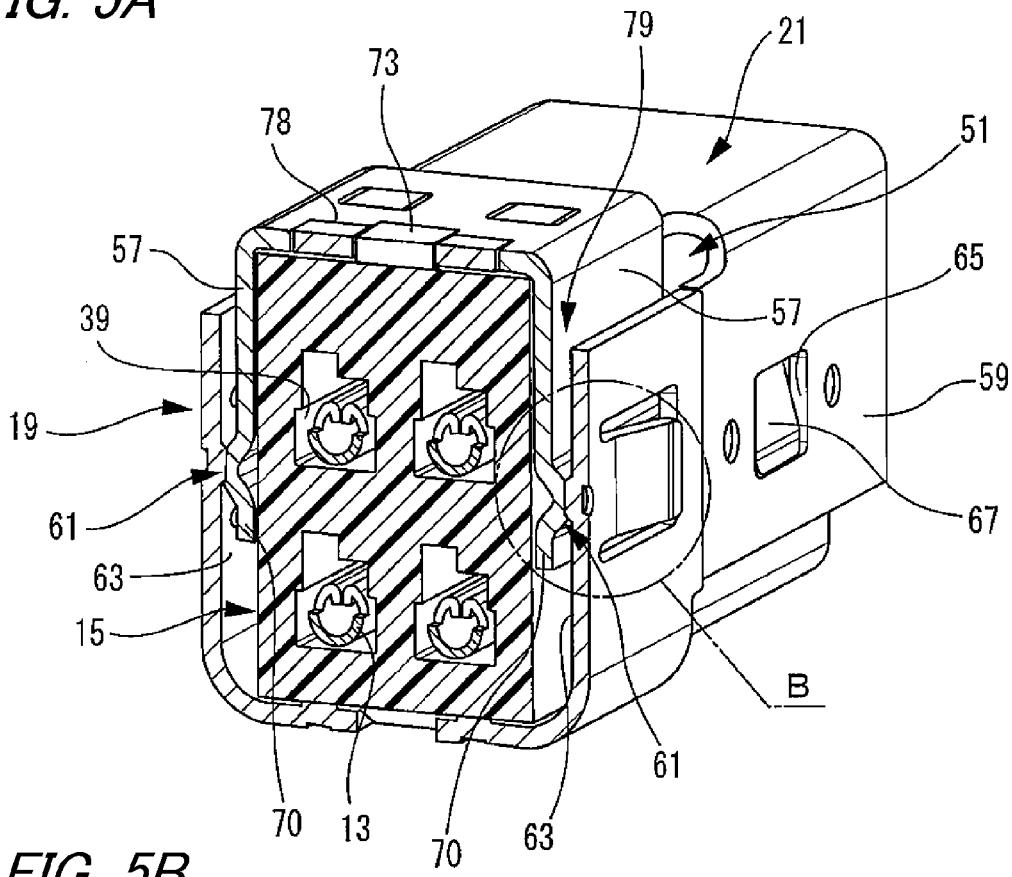
FIG. 5A is a cross sectional perspective view taken when the shielded shell shown in FIG. 3 is cut along line A-A.
Figure 5B:
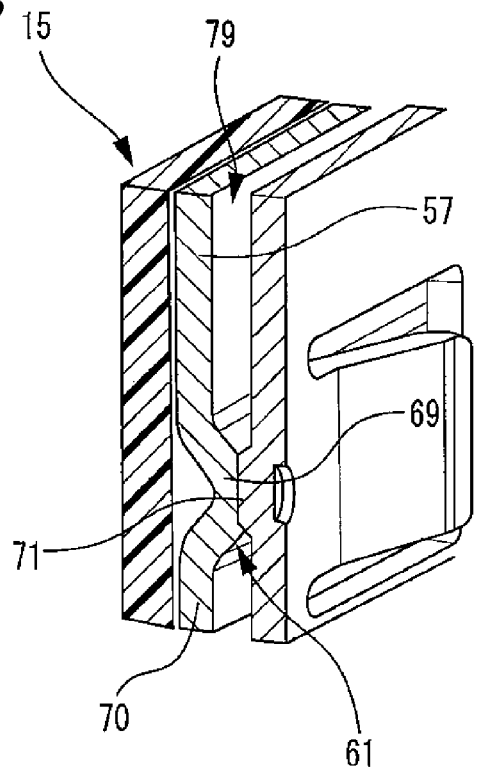
FIG. 5B is a partially enlarged view of B in FIG. 5A.

As shown in FIGS. 5A and 5B, a protuberance 61 projecting outside with respect to a broadening direction is formed on each of the insertion laps 57. The shielded shell cover 21 is fitted to the shielded shell 19 in such a way that both insertion laps 57 overlap respective side plate interior surfaces 63 of the shielded shell 19 to thereby cover the opening 51 from above.

Since the leading ends of the pair of insertion laps 57 remain broadened on this occasion, the insertion laps 57 are inserted into insertion space while being nipped in a closing direction. The insertion laps 57 inserted into an interior of the shielded shell 19 are again broadened by dint of elastic restoring force, thereby being pressed against the respective side plate interior surfaces 63 of the shielded shell 19.

Furthermore, when the pair of insertion laps 57 are inserted into the shielded shell 19, the protuberances 61 formed on the pair of insertion laps 57 reliably press the respective side plate interior surfaces 63 of the shielded shell 19. Engagement holes 65 formed in the respective cover side plates 59 are engaged with engagement claws 67 formed on the respective sides of the shielded shell 19, whereby the shielded shell cover 21 in which the side plate interior surfaces 63 are pressed by the respective protuberances 61 is fastened to the shielded shell 19 as shown in FIG. 3.

The protuberances 61 of the present embodiment are longitudinal groove-like protuberances 69 provided in a projecting manner along a direction of insertion of the shielded connector 11. As a result of the protuberances 61 being formed as continual, longitudinal, groove-like protuberances 69, a contact area between the shielded shell 19 and the shielded shell cover 21 can be increased when compared with that achieved by means of scattered hemispherical protuberances. Further, the longitudinal groove-like protuberances 69 that each have a chevron-shaped cross sectional profile are formed by folding, whereby rigidity of the insertion laps 57 of the shielded shell cover 21 can be enhanced. In addition, each of the longitudinal groove-like protuberances 69 extends at a position slightly located backward from a leading insertion edge that is the leading edge of each of the insertion laps 57 and along the leading insertion edge, whereby a flange piece 70 is formed on the leading end side of each of the insertion laps 57. Accordingly, when the insertion laps 57 are inserted into the shielded shell 19, the flange pieces 70 act as insertion guides, thereby facilitating inserting operation.

Moreover, as shown in FIG. 5B, a contact 71 opposing the corresponding protuberance 61 is projectingly provided on each of the side plate interior surfaces 63 of the shielded shell 19. The shielded shell 19 and the shielded shell cover 21 can thereby be brought into more reliable contact with each other by means of the protuberances 61 and the contacts 71 that are given such a dimensional relationship that they project each other in a contacting direction and overlap each other.

The outer housing 23 is molded from a synthetic resin material into an angled tubular shape. A shell attachment space 85 is formed inside the outer housing 23. The inner housing 15 covered with the sealed shell 19 is inserted into the shell attachment space 85. The rear folder 25 is engaged with a rear portion of the outer housing 23 that accommodates the inner housing 15 within the shell attachment space 85. As a result of the rear folder 25 being engaged with the outer housing 23, dropping off of the inner housing 15 is restricted, and the shielded electric wire 27 led out of the inner housing 15 is supported.

Figure 6A:
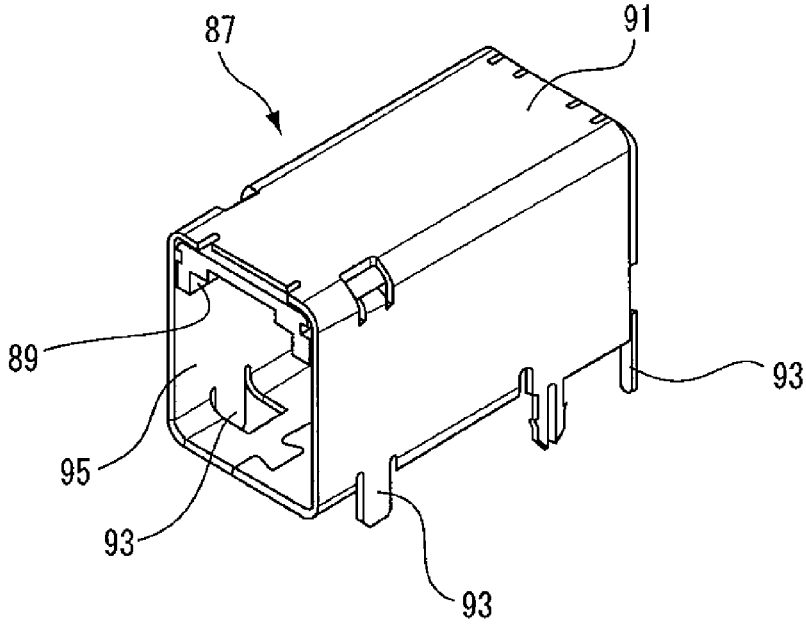
FIG. 6A is a perspective view of a counterpart connector.
Figure 6B:
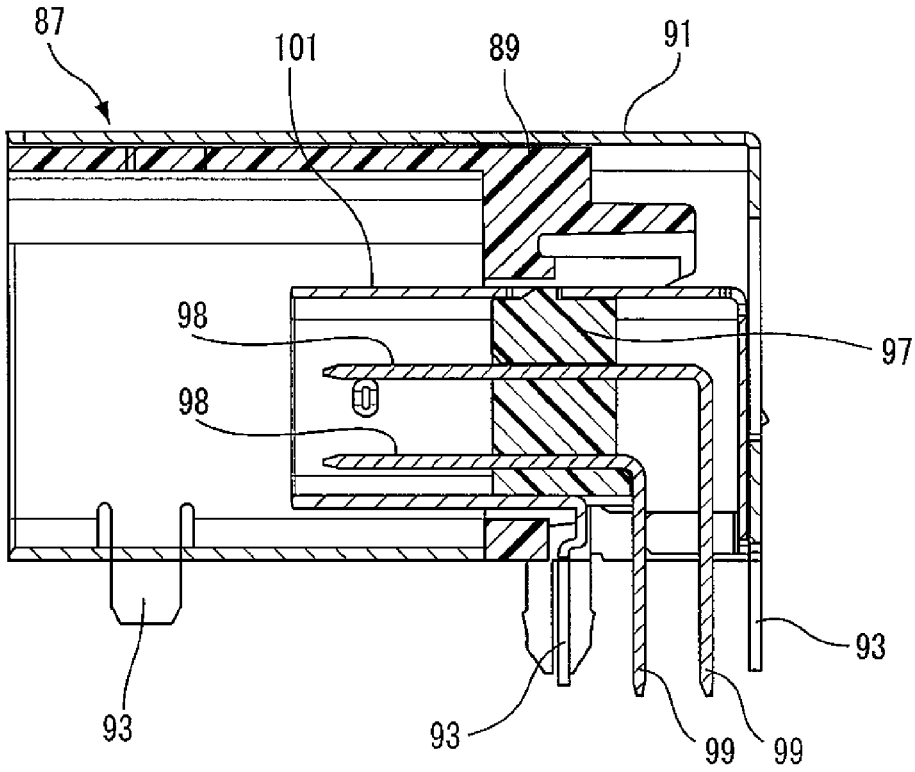
FIG. 6B is a cross sectional view of the counterpart connector shown in FIG. 6A.

In a counterpart connector 87 shown in FIGS. 6A and 6B, an outside of a counterpart outer housing 89 is covered with an outer shielded shell 91. Substrate connections 93 are provided upright on the outer shielded shell 91. The substrate connections 93 are soldered to respective through holes formed in a substrate of an unillustrated electronic equipment and concurrently connected to a ground of the substrate. A connector fitting space 95 intended for receiving the shielded connector 11 is formed in the counterpart outer housing 89. A counterpart inner housing 97 is provided in the connector fitting space 95. The counterpart inner housing 97 accommodates the plurality of tabs 98 that are counterpart male terminals. As a result of a lead 99 being soldered to through holes of an unillustrated substrate, the tabs 98 are connected to a predetermined circuit. The tabs 98 are connected to the respective terminal 13 of the shielded connector 11. The counterpart inner housing 97 is covered with a counterpart inner shell 101. The substrate connections 93 are provided upright on the counterpart inner shell 101, and the substrate connections 93 are soldered to respective through holes of the unillustrated substrate and concurrently connected to the ground of the substrate.

Procedures for assembling the shielded connector 11 having the above structure and operation of the shielded connector 11 are now described.

As shown in FIG. 1, in order to assemble the shielded connector 11, the terminals 13 are connected to the respective terminals of the plurality of shielded wires of the shielded electric wire 27 by means of crimping, to thus assemble the terminal equipped shielded electric wire 29. The terminals 13 of the terminal equipped shielded wire 29 are inserted into the respective terminal accommodation chambers 39 of the inner housing 15.

Next, the front folder 17 is assembled into the inner housing 15 from the front. As shown in FIG. 2, the inner housing 15 into which the front folder 17 is assembled is fitted to the shield 47 of the shielded shell 19. As indicated by reference symbol H in FIG. 4, an inner height of the shielded shell 19 is substantially identical with a total height of the inner housing 15. Because of this, the inner housing 15 does not cause any rattle inside the shielded shell 19 in the vertical direction. The inner housing 15 fitted into the shielded shell 19 crimps and fastens the sheath 33 of the shielded electric wire 27 led out from the rear portion of the shielded shell 19 by means of the barrel 55 of the shielded shell 19.

As shown in FIG. 3, in the inner housing 15, an engagement projection 73 formed on an upper surface of the inner housing 15 is engaged with an engagement recess 75 formed in a rear edge 78 of an upper portion of the shield 47, thereby being fixed while being prevented from causing a rattle in a direction of width W with respect to the shielded shell 19. As mentioned above, swaging of the sheath 33 performed by the barrel 55 is carried out while the inner housing 15 is reliably fixed, so that high precision swaging becomes feasible.

As shown in FIG. 2, an uncovered portion of shielded line 77 is equipped and covered with the shielded shell cover 21.

The shielded shell cover 21 is nipped in a closing direction in such a way that the pair of insertion laps 57 become elastically deformed in a direction where they come close to each other. First, the flange pieces 70 are inserted into insertion clearance 79 (see FIGS. 5A and 5B) defined between both side surfaces of the inner housing 15 and the side plate interior surfaces 63 of the shielded shell 19 enclosing the inner housing from the outside. When the longitudinal groove-like protuberances 69 come into upper edges of the respective side plates of the shielded shell 19, the insertion laps 57 are further pushed into, thereby letting the longitudinal groove-like protuberances 69 move to a deeper position in the insertion clearance 79.

As above, after the insertion laps 57 have been inserted into the insertion clearance 79 existing between the inner housing 15 and the shielded shell 19, the shielded shell cover 21 is attached. Specifically, as shown in FIG. 3 and FIGS. 5A and 5B, the insertion laps 57 of the shielded shell cover 21 will not project outside of the shielded shell 19. The shielded shell 19 is fitted to the outer housing 23 in this state. Finally, the rear folder 25 is engaged with the outer housing 23 accommodating the inner housing 15, thereby completing assembly of the shielded connector 11.

As mentioned above, in order to pursue miniaturization of the shielded connector 11 of the present embodiment, the inner housing 15 is formed so as to become smaller than the shielded shell 19 by an amount corresponding to an extent to which the insertion laps 57 of the shielded shell cover 21 are inserted to the outside of both side surfaces of the inner housing 15.

In relation to the shielded connector 11, the pair of mutually opposed parallel insertion laps 57 of the shielded shell cover 21 that is formed so as to assume a substantially C-shaped cross sectional profile are formed in the course of the folding process such that the leading ends of the insertion laps 57 become rather broadened by spring back. The protuberance 61 projecting toward the outside in the broadening direction is formed on each of the insertion laps 57.

When the shielded shell cover 21 is attached to the shielded shell 19, both insertion laps 57 are inserted into the respective insertion clearances 79 existing between the inner housing 15 and the shielded shell 19 so as to overlap the side plate interior surfaces 63 of the shielded shell 19. On this occasion, the leading ends of the pair of respective insertion laps 57 are broadened much wider than are both side plates of the shielded shell 19 and hence inserted into the respective insertion clearances 79 while being nipped in the closing direction.

The insertion laps 57 inserted into the respective insertion clearances 79 inside the shielded shell 19 are again broadened by means of elastic restoring force, thereby pressing the side plate interior surfaces 63 of the shielded shell 19. Accordingly, the longitudinal groove-like protuberances 69 provided on the respective insertion laps 57 reliably press the respective side plate interior surfaces 63. Hence, it is possible to prevent deformation of the side plate interior surfaces 63; for instance, occurrence of irregularities in the side plate interior surfaces 63, or creation of instability in a state of a contact, which would otherwise be caused by an assembly error, and the like.

Accordingly, by means of the shielded connector 11 of the present embodiment, the shielded shell cover 21 and the shielded shell 19 can be brought into reliable contact with each other while pursuing miniaturization. Hence, superior shielding performance can be accomplished.

In the case where both side plates of a remaining C-shaped cover body are assembled to one C-shaped cover body so as to cover its both sides plates from the outside in the same manner as in the related-art shielded connector described in connection with Patent Document 2, or the like, if both side plates of the remaining C-shaped cover body are formed so as to become rather closed in order to press both side plate exterior surfaces of the one C-shaped cover body, the cover bodies must be assembled while both side plates of the remaining C-shaped cover body remain broadened, which results in serious impairment of ease of assembly.

The shielded connector of the present invention is not limited to the embodiment and susceptible to deformations, modifications, or the like. In addition, the constituent elements of the present embodiment are arbitrary and are not limited in terms of materials, shapes, dimensions, numbers, and positions, so long as the present invention can be achieved.

The present application is based on Japanese patent application No. 2011-184055 filed on Aug. 25, 2011, and the contents of the patent application are incorporated herein by reference.

Industrial Applicability

The present invention is useful for providing a shielded connector that makes it possible to bring a shielded shell into reliable contact with a shielded shell cover while pursing further miniaturization.

What is claimed is:

1. A shielded connector including:

a shielded shell having an electric wire fixing section for fixing a sheath of a shielded electric wire and a rectangular cylindrical shield having an opening in an upper surface of the shell; and a shielded shell cover that has a pair of mutually opposed insertion laps to cover the opening and that assumes a substantially C-shaped cross sectional profile, wherein when the pair of insertion laps are inserted inside the shielded shell in order to cover the opening, protuberances provided on the pair of insertion laps press side plate interior surfaces of the shielded shell, and wherein contacts that oppose the respective protuberances are provided in a projecting manner on the respective side plate interior surfaces of the shielded shell.

2. A shielded connector including:

a shielded shell having an electric wire fixing section for fixing a sheath of a shielded electric wire and a rectangular cylindrical shield having an opening in an upper surface of the shell; and a shielded shell cover that has a pair of mutually opposed insertion laps to cover the opening and that assumes a substantially C-shaped cross sectional profile, wherein when the pair of insertion laps are inserted inside the shielded shell in order to cover the opening, protuberances provided on the pair of insertion laps press side plate interior surfaces of the shielded shell, wherein the protuberances are longitudinal groove-like protuberances projectingly provided along a direction of insertion of the shielded connector, and wherein contacts that oppose the respective protuberances are provided in a projecting manner on the respective side plate interior surfaces of the shielded shell.

* * * * *